United States Patent [19]

Yamamoto et al.

[11] Patent Number: 4,824,822

[45] Date of Patent: Apr. 25, 1989

[54] THERMOSENSITIVE RECORDING MATERIAL

[75] Inventors: Yoichi Yamamoto, Nara; Hironori Fujii, Osaka; Toshio Oichi, Itami, all of Japan

[73] Assignees: Sharp Kabushiki Kaisha, Osaka; Sugai Chemical Industry Co., Ltd., Wakayama, both of Japan

[21] Appl. No.: 191,821

[22] Filed: Mar. 28, 1988

Related U.S. Application Data

[63] Continuation of Ser. No. 756,269, Jul. 18, 1985, abandoned.

[30] Foreign Application Priority Data

Jul. 24, 1984 [JP] Japan ..... 59-154879

[51] Int. Cl.[4] ..... B41M 5/035; B41M 5/22; G03C 5/00

[52] U.S. Cl. ..... 503/201; 8/471; 427/152; 427/256; 427/261; 428/195; 428/913; 428/914; 430/335; 430/336; 430/344; 503/217; 503/226; 503/227

[58] Field of Search ..... 8/470, 471; 427/150–152, 256, 288, 261; 428/195, 913, 914; 430/335, 336, 344; 503/201, 217, 226, 227

[56] References Cited

U.S. PATENT DOCUMENTS

| | | | |
|---|---|---|---|
| Re. 28,956 | 9/1976 | Wainer | 430/335 |
| 3,116,148 | 12/1963 | Miller | 430/336 |
| 3,322,557 | 5/1967 | Schwab | 430/336 |
| 3,454,764 | 7/1969 | Collier et al. . | |
| 3,502,871 | 3/1970 | Marx, Jr. et al. . | |
| 3,754,914 | 8/1973 | Inoue et al. | 430/335 |
| 3,936,307 | 2/1976 | Asakawa et al. | 430/336 |

FOREIGN PATENT DOCUMENTS

| | | | |
|---|---|---|---|
| 0026096 | 4/1981 | European Pat. Off. | 346/226 |
| 2133950 | 12/1972 | France . | |
| 0012913 | 1/1980 | Japan | 346/226 |
| 1160222 | 8/1969 | United Kingdom . | |
| 1160224 | 8/1969 | United Kingdom . | |
| 1182626 | 2/1970 | United Kingdom . | |
| 1191460 | 5/1970 | United Kingdom . | |
| 1345331 | 1/1974 | United Kingdom | 430/336 |

OTHER PUBLICATIONS

C. Holstead et al., *The Journal of Photographic Science*, vol. 25, pp. 241–245 (1977).

*Primary Examiner*—Bruce H. Hess
*Attorney, Agent, or Firm*—Spencer & Frank

[57] ABSTRACT

A thermosensitive recording method which comprises heat-treating compounds A and B constituting a coloring matter resulting in sublimation or evaporation to thereby bring these two compounds into contact with each other on a recording sheet, resulting in a color image on the recording sheet.

7 Claims, No Drawings

THERMOSENSITIVE RECORDING MATERIAL

This application is a continuation of application Ser. No. 756,269, filed on Jul. 18, 1985, now abandoned.

BACKGROUND OF THE INVENTION

1. Field of the invention:

This invention relates to a thermosensitive recording method for the formation of a color image on a recording sheet by a sublimation or evaporation process resulting from a heat-treatment of components constituting a coloring matter. 2. Description of the prior art:

A conventional thermosensitive recording method, using sublimable dispersed dyes or dye precursors to be colored in contact with cationic dyes or acids, is disclosed in Japanese Laid Open Patent Publication No. 58-220788 (220788/1983), wherein these dyes are directly sublimed or evaporated on a recording sheet by a heat-treatment thereof to form a color image on the recording sheet. However, since each of these dyes has an very great molecular weight, the heat-treatment thereof requires a great amount of energy to the extent of as much as 0.2 W/a dot at the head portion of a thermosensitive recorder, making it difficult to produce a small-scaled thermosensitive recorder and requiring an extended recording time.

SUMMARY OF THE INVENTION

The thermosensitive recording method of this invention which overcomes the above-discussed and numerous other disadvantages and deficiencies of the prior art, comprises heat-treating compounds A and B constituting a coloring matter resulting in sublimation or evaporation to thereby bring these two compounds into contact with each other on a recording sheet, resulting in a color image on the recording sheet.

The compound A is, in a preferred embodiment, at least one compound selected from materials forming free radicals.

The compound B is, in a preferred embodiment, at least one compound selected from aromatic amines.

The compound B is, in a preferred embodiment, sublimed or evaporated onto the recording sheet, which has been pre-coated with at least one of said materials forming free radicals, to allow the reaction thereof with said materials on the recording sheet.

The compounds A and B pre-coated on a substrate are, in a preferred embodiment, sublimed or evaporated onto the recording sheet, resulting in a color image on the recording sheet.

Thus, the invention described herein makes possible the objects of (1) providing a thermosensitive recording method by which a color image is readily formed on a recording sheet with a limited energy consumption; (2) providing a thermosensitive recording method in which since compounds A and B used herein are intermediates of a coloring matter, the amount of energy required for sublimation or evaporation of the compounds A and/or B is extremely small when compared with that for sublimation or evaporation of the coloring matter itself according to a conventional recording method, thereby allowing for the minimization of the size of the thermosensitive recorder therefor; (3) providing a thermosensitive recording method which enables the shortening of the transferring process due to a limited energy consumption per dot at the head of the recorder; (4) providing a thermosensitive recording method which attains synthesis of the coloring matter on a recording sheet by subliming or evaporating intermediates of the coloring matter, resulting in a color image having the desired color intensity under the control of the sublimation temperature and/or the sublimation time; (5) providing a thermosensitive recording method which can be combined with a conventional recording method for the thermotransfer of a coloring matter together with a binder, resulting in a distinct color image without a chromatic aberration.

DESCRIPTION OF THE PREFERRED EMBODIMENTS

The aromatic amines used as compound B are components (i.e., intermediates) of a coloring matter, and the molecular weight of each of them is very much smaller than that of the coloring matter itself, so that they require only a little energy to be sublimed or evaporated. Thus, when the sublimed aromatic amines react on a recording sheet in the presence of light with materials forming free radicals, such as compound A which is pre-coated on the recording sheet to synthesize the coloring matter, the energy consumption at the head of a thermosensitive recorder can be reduced as compared with a conventional method for the thermo-transfer of the coloring matter itself on a recording sheet.

The resulting color image on the recording sheet consists of molecularly dispersed coloring matter resulting in an excellent transparence of the coloring matter. Thus, the mixing ratio of the three primary colors can be determined with a great precision resulting in the desired hue of the color image. As the compound A, activated clay can be used, instead of the materials forming free radicals, in combination with aromatic amines as the compound B. As the compounds A and B, any combination of contact coloring substances can be used and are not limited to the above-mentioned.

Both of the compounds A and B can be, of course, sublimed or evaporated to synthesize a coloring matter on a recording sheet. The method of this invention can also be combined with the conventional method for the thermo-transfer of the coloring matter together with a binder. Any of the above-mentioned methods can attain the formation of a color image with a limited energy consumption.

Examples of the materials forming free radicals used as the compound A are carbon tetrachloride, carbon tetrabromide, dibromomethane, iodoform, chloroform, bromoform, bromochloroform, hexachloroethane, tetrachloroethylene, trichloroacetophenone, tribromoacetophenone, p-nitrobenzotribromide, benzotrichloride, hexachlorobenzene, hexabromomethylsulfone, hexachloromethylsulfone, N-tribromomethyltriazine, tribromomethylphenylsulfone, tribromoacetic acid, tribromoethane, tribromoethylene, etc. The addition of sensitizers, image-stabilizers, etc., to the compound A shortens the coloring process and results in a more distinct color image.

As the compound B, aromatic amines and its derivatives, aromatic hydroxyl compounds and its derivates indole and its derivatives, azobenzene and its derivatives, quinoline and its derivatives, naphthoquinone and its derivatives, imidazole and its derivatives, diphenylamine and its derivatives, styrile base and its derivatives, triphenylamine and its derivatives, N-vinylcarbazole and its derivatives, carbazole, pyridine, isoquinoline, pyrimidine, pyridazine, pyrazine, cinnoline, quinazoline, pyrrole, pyrazole, oxazole and their derivatives, and other heterocyclic derivatives can be used.

Example 1

A recording sheet was immersed in an acetone solution containing hexabromomethylsulfone as the compound A in a concentration of 3% by weight for a certain period and then dried, resulting in a pretreated recording sheet C. Another recording sheet was immersed in an acetone solution containing m-hydroxyldiphenylamine as the compound B in a concentration of 3% by weight and then dried, resulting in a pre-treated recording sheet D. The recording sheet D was placed upon the recording sheet C, and the set was then subjected to a heat-treatment at a temperature of 130° C. for 0.3 to 2 milliseconds resulting in sublimation of m-hydroxyldiphenylamine from the recording sheet D to the recording sheet C. Then, the recording sheet C was exposed to a fluorescent lamp, resulting in a black image corresponding to the portion of the recording sheet C, on which m-hydroxyldiphenylamine from the recording sheet D had been transferred.

Example 2

A recording sheet was treated with carbon tetrabromide, in the same manner as in Example 1, resulting in a pre-treated recording sheet C. Another recording sheet was treated with p-aminoazobenzene, in the same manner as in Example 1, resulting in a pre-treated recording sheet D. The recording sheet D was placed upon the recording sheet C, and the set was then subjected to a heat-treatment at a temperature of 130° C. for 0.5 to 2 milliseconds. Then, a recording sheet D' which had been treated with diphenylamine was placed upon the recording sheet C and heat-treated at a temperature of 130° C. for 0.5 milliseconds, followed by exposure, resulting in a distinct color image composed of a red, blue and violet portion. The red portion corresponds to the portion of the recording sheet C, on which p-aminoazobenzene from the recording sheet D had been transferred. The blue portion corresponds to the portion of the recording sheet C, on which diphenylamine from the recording sheet D' had been transferred. The violet portion corresponds to the portion of the recording sheet C, on which both the sheets D and D' were placed.

Example 3

A recording sheet was immersed in an acetone solution containing hexabromomethylsulfone and benzoquinoline in a concentration of 3% by weight each for a certain period and then dried to result in a pretreated recording sheet C, upon which a recording sheet D pre-treated with p-dimethylaminobenzoaldehyde was then placed, followed by heating at a temperature of 80° C. for 2 milliseconds. Upon the side of the recording sheet C, a recording sheet D' pre-treated with N-ethyl-α-naphthylamine was placed and subjected to a heat-treatment at a temperature of 80° C. for 2 milliseconds, followed by exposure, resulting in a distinct image composed of a yellow, blue and green portion. The yellow portion corresponds to the portion of the recording sheet C, on which p-dimethylaminobenzoaldehyde from the recording sheet D had been transferred. The blue portion corresponds to the portion of the recording sheet C, on which N-ethyl-α-naphthylamine from the recording sheet D' had been transferred. The green portion corresponds to the portion of the recording sheet C, upon which both the recording sheets D and D' were placed.

Example 4

A recording sheet D pre-treated with p-aminoazobenzene was placed upon a recording sheet C pretreated with hexabromomethylsulfone, and then subjected to a heat-treatment at a temperature of 130° C. for 0.5 to 2 milliseconds. Thereafter, a recording sheet D' pre-treated with p-dimethylaminobenzoaldehyde was placed thereupon and subjected to a heat-treatment at a temperature of 130° C. for 1 second, followed by exposure, resulting in a distinct color image composed of a red, yellow and orange portion. The red portion corresponds to the portion of the recording sheet C, on which p-aminoazobenzene from the recording sheet D had been transferred. The yellow portion corresponds to the portion of the recording sheet C, on which p-dimethylaminobenzoaldehyde from the recording sheet D' had been transferred. The orange portion corresponds to the portion of the recording sheet C, upon which both the recording sheets D and D' were placed.

Example 5

A donor pre-coated with P-N-diethylaminoazobenzene and a binder was placed upon an acceptor precoated with an ink, which was prepared by dispering and/or dissolving hexabromomethylsulfone, a stabilizer and a binder into water or an organic solvent, and then subjected to a heat-treatment at a temperature of 120° C. for a certain period, followed by exposure to light, resulting in a distinct image of a Magenta color.

Example 6

A polyester film pre-coated with P-dimethylaminobenzaldehyde and tribromomethylphenylsulfone was placed upon a recording sheet, and the set was then subjected to a heat-treatment at a temperature of 130° C. or more for 0.5 milliseconds by a thermal head, followed by exposure to light resulting in a yellow image corresponding to the portion of the recording sheet, on which P-dimethylaminobenzaldehyde and tribromomethylphenylsulfone from the polyester film had been transferred.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A thermosensitive recording method, comprising;

providing a first recording sheet pre-treated with a compound A, and a second recording sheet pretreated with a compound B, and placing said first recording sheet upon said second recording sheet to form a set of recording sheets, heat-treating said set of recording sheets resulting in sublimation or evaporation of compound B to bring these two compounds into contact with each other on said first recording sheet, resulting in a latent image on said first recording sheet, and exposing said first recording sheet to light to produce a color image on said first recording sheet corresponding to said latent image.

2. A thermosensitive recording method according to claim 1, wherein said compound A is at least one compound selected from materials forming free radicals.

3. The thermosensitive recording method of claim 2, wherein said compound B is sublimed onto said first recording sheet, which has been pre-coated with at least one of said materials forming free radicals, to allow the reaction thereof with said materials on said first recording sheet.

4. The thermosensitive recording method of claim 2 wherein compound A is selected from the group consisting of carbon tetrachloride, carbon tetrabromide, dibromomethane, iodoform, chloroform, bromoform, bromochloroform, hexachloroethane, tetrachloroethylene, trichloroacetophenone, tribromoacetophenone, p-nitrobenzotribromide, benzotrichloride, hexachlorobenzene, hexabromomethylsulfone, hexachloromethylsulfone, N-tribromomethyltriazine, tribromomethylphenylsulfone, tribromoacetic acid, tribromoethane, and tribromoethylene.

5. A thermosensitive recording method according to claim 1 wherein said compound B is at least one compound selected from aromatic amines.

6. The thermosensitive recording method of claim 5 wherein compound B is selected from the group consisting of aromatic amines, indoles, azobenzenes, quinolines, naphthoquinones, imidazoles, diphenylamines, styrile bases, triphenylamines, N-vinylcarbazoles, carbazoles, pyridine, isoquinoline, pyrimidine, pyridazine, pyrazine, cinnoline, quinazoline, pyrrole, pyrazole, and oxazole.

7. The thermosensitive recording method of claim 1, wherein said compounds A and B pre-coated on a set of recording sheets are evaporated onto said first recording sheet, resulting in a color image on said first recording sheet.

* * * * *